US008596620B2

(12) United States Patent
Imhof

(10) Patent No.: US 8,596,620 B2
(45) Date of Patent: Dec. 3, 2013

(54) DEVICE FOR DISPENSING A GAS INTO A LIQUID

(75) Inventor: Rainer Imhof, Dorsten (DE)

(73) Assignee: Maelgwyn Mineral Services Limited, Cardiff Bay (GB)

( * ) Notice: Subject to any disclaimer, the term of this patent is extended or adjusted under 35 U.S.C. 154(b) by 881 days.

(21) Appl. No.: 12/377,207

(22) PCT Filed: Aug. 13, 2007

(86) PCT No.: PCT/GB2007/003074
§ 371 (c)(1),
(2), (4) Date: May 6, 2010

(87) PCT Pub. No.: WO2008/017875
PCT Pub. Date: Feb. 14, 2008

(65) Prior Publication Data

US 2010/0220544 A1 Sep. 2, 2010

(30) Foreign Application Priority Data

Aug. 11, 2006 (GB) ..... 0616043.6

(51) Int. Cl.
*B01F 3/04* (2006.01)

(52) U.S. Cl.
USPC ..... 261/77; 261/118; 261/119.1; 261/121.1; 261/DIG. 75

(58) Field of Classification Search
USPC ..... 261/76, 77, 118, 119.1, 121.1, DIG. 75
See application file for complete search history.

(56) References Cited

U.S. PATENT DOCUMENTS 6,682,057 B2 * 1/2004 La Crosse ..... 261/76

* cited by examiner

*Primary Examiner* — Robert A Hopkins
(74) *Attorney, Agent, or Firm* — Cook Alex Ltd.

(57) ABSTRACT

An aeration cartridge (10) within an outer vessel, the aeration cartridge (10) comprising a tube (18) constructed from two or more longitudinally joined cylindrical sections (20), wherein respective ends of the cylindrical sections (20) are shaped so that when they are joined together, at least one slot (24) passing from an inner surface of the tube (18) to an outer surface of the tube (18) is created at the join, and wherein the outer vessel is capable of being connected to a high pressure gas supply.

36 Claims, 2 Drawing Sheets

DEVICE FOR DISPENSING A GAS INTO A LIQUID

The invention relates to a device for dispersing a gas into a liquid, or a suspension of particles in a liquid, especially, but not exclusively, on mineral slurries, which are in tanks or flow in pipe systems.

One current system for dispersing a gas into a liquid utilises a rotating impeller within a confined tank. The tank is filled with liquid and a gas is introduced via nozzles close to the rotating impeller. The shear in the liquid created by the velocity of the rotating impeller disperses the gas into small bubbles. The size of the bubbles created is dependent on physical variables present in the system, such as the rotational speed of the impeller, the hydraulic pressure in the liquid, the viscosity of the liquid and the surface tension of the liquid. The diameter of the nozzle and the flow rate of gas into the system also contribute to the size of bubbles being created. The efficiency of producing new gas/liquid interfaces relative to the energy consumed by the impeller is relatively low.

A second method of dispersing gas into a liquid introduces the gas through orifices, wherein the orifices are of a diameter equal to that of the desired bubble diameter. The liquid viscosity and surface tension are not as dominant in determining the bubble diameter as in mechanical devices such as impeller systems. Single small orifices are limited in capacity for mass transfer. Therefore porous media with extremely high numbers of pores per unit area of media are used in technical applications.

A common example of the use of porous media aeration is in the processing of biological sludge. Porous tubes are placed deep in the sludge basin where they are charged with compressed air. Although the porous media pores are less than 0.1 mm in diameter, the diameter of the bubbles produced is approximately 0.2 to 0.5 mm, which is relatively large. This is due to there being no shear at the end of the pores to remove small bubbles and so the bubbles coalesce to form larger bubbles. For this reason, porous media are used in a cross flow process, that is, the liquid passes over the surface of the porous media at a high velocity to shear the bubbles before they coalesce. Using this method and very fine pored porous media, bubbles of diameters with less than 0.1 mm can be achieved.

There are two main disadvantages when using porous media for the dispersion of gases into liquids. Firstly, the characteristics of the media change during use, for instance, the specific permeability (mass transfer at a given gas pressure in relation to the media interface) is reduced over a period of time. This can be compensated for by an increase in the gasses operating pressure. However, the gas pressure can only be increased to a certain point, after which the media requires removing and cleaning or replacing. In some circumstances the media can not be cleaned and remains blocked with particles from the liquid or suspension. The blocking, or blinding, of the media is either caused by small particles from the suspension penetrating into the pores and/or by chemical precipitation of small crystals inside the pores. One of the main reasons for blocking is that there are wide ranges of pore sizes, around 1 μm to 20 μm, present in the media. Modern porous media are made from polytetrafluoroethylene (PTFE), because the wetability of this polymer is low, the liquid does not penetrate deep into the pores helping reduce blocking, but not eliminating it.

A second disadvantage of using porous media is the wear rate of the media. The nature of the cross flow reactor causes particles in the liquid or suspension to abrade the media at high speeds, which breaks the material down over a relatively short period of time. At liquid velocities of 5 m/s to 6 m/s the wear rate of the porous media is still acceptable. However, the amount of shear is not sufficient to produce very small bubbles. Liquid velocities of between 9 m/s and 10 m/s reach a compromise between bubble size and wear rate of the media.

The present invention seeks to provide a remedy for one or more of the disadvantages.

According to the present invention, there is provided an aeration cartridge within an outer vessel, the aeration cartridge comprising a tube constructed from two or more longitudinally joined cylindrical sections, wherein respective ends of the cylindrical sections are shaped so that when they are joined together, at least one slot passing from an inner surface of the tube to an outer surface of the tube is created at the join, and wherein the outer vessel is capable of being connected to a high pressure gas supply.

Preferably, at least part of the inner surface of the two or more cylindrical sections is superhydrophobic. The superhydrophobic effect, or lotus-effect, allows the, or each, slot to be self-cleaning and so reduces the likelihood of the slots becoming blocked, or blinded, by particles from the liquid or suspension passing through the cylindrical sections.

Advantageously, the slots are perpendicular to the inner surface of the tube. They may also be angled up to 60° to the perpendicular in either direction. Furthermore, they may be tapered, being wider on the outer surface of the tube and narrowing on the inner surface of the tube. The slots may also be of various shapes.

Advantageously, the ends of the cylindrical sections are shaped by means of a Computer Numerical Control milling machine.

Advantageously, the cylindrical sections comprise ceramic material. Preferably, the ceramic material is SiC or $Al_2O_3$. Such ceramic materials have a relatively high resistance to wearing compared to porous media. Using high-quality silicon carbide ceramic materials reduces the frequency at which the aeration cartridge requires replacing due to wearing, compared to the frequency of replacement normally seen in aeration devices. Such high wear resistant ceramics also allow for liquid speeds of in excess of 20 m/s to be used without producing as much wear on the material as is produced in porous media. A further advantage of using the ceramic materials is that more abrasive liquids or suspensions may be treated than otherwise would have been the case because of the high degree of wear on the parts of the aeration device.

Preferably, the width of the, or each, slot is between 0.01 mm and 0.5 mm. As an example, a slot width of 0.1 mm would provide bubbles in the size range of 0.02 mm to 0.1 mm dependent upon the speed of the cross flowing liquid.

Advantageously, the pressure of the high-pressure gas supply is 200 kilopascal (2 bar) to 1 500 kilopascal (15 bar).

Preferably, the aeration device is used in a cross-flow reactor.

The invention further extends to a method of dispersing a gas into a liquid.

An embodiment of the present invention will now be described in relation to the accompanying drawings, wherein.

Figure 1:
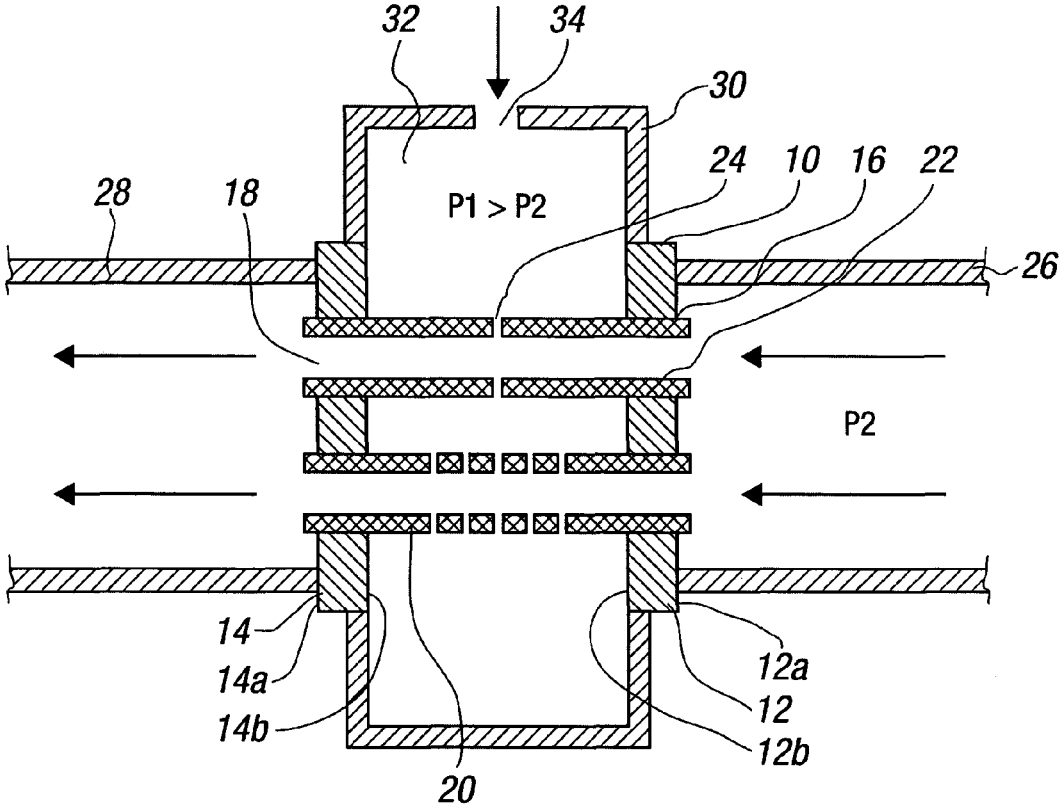
FIG. 1 shows a diagrammatic cross-section of the device.

FIG. 1 shows a device comprising an aeration cartridge 10 comprising two end plates 12 and 14, held together by a series of bolts (not shown), having a series of apertures 16 passing from an outside edge 12*a* and 14*a* of end plates 12 and 14 respectively to an inside edge 12*b* and 14*b* of end plates 12 and 14 respectively. A plurality of ceramic wear resistant tubes 18, constructed from a least two longitudinally joined ceramic, wear-resistant cylindrical sections 20, pass through apertures 16 in end plates 12 and 14. At least part of the internal walls 22 of ceramic cylindrical sections 20 are treated with chemical's to make them superhydrophobic.

The ends ceramic cylindrical sections 20 making up the tubes 18 are shaped, using a Computer Numerical Controlled milling machine, so that when they are joined together, at least one slot 24 passing from the inner surface of tube 18 to the outer surface of tube 18 is formed at each join. Such tubes may be formed from two ceramic cylindrical sections 20, creating a single slot in the tubes 18 (mono-slot system), or a plurality of ceramic cylindrical sections, creating a plurality of slots in tubes 18 (multi-slot system). The ends of tubes 18 extending beyond the end plates 12 and 14 are fitted with silicon carbide inserts (not shown) to ensure no wear occurs at these points.

Sealingly attached the outside of the aeration cartridge 10, perpendicular to end plate 12 is an in-flow pipe 26, with a diameter such that the ends of tubes 18 protruding beyond end plate 12 are wholly within the circumference of in-flow pipe 26. Sealingly attached to the opposite side of aeration cartridge 10, perpendicular to end plate 14, is an out-flow pipe 28 with a diameter such that the ends of tubes 18 protruding beyond end plate 14, are wholly within the circumference of out-flow pipe 28. Thus, in-flow pipe 26 is in fluid communication with out-flow pipe 28 via tubes 18.

Sealingly attached to the circumference of the end plates 12 and 14 is a surround 30. The surround 30 in combination with end plates 12 and 14 form an outer vessel 32 about the aeration cartridge 10. A gas inlet 34 is provided in the surround 30 of the outer vessel 32.

When in use, a liquid or suspension is pumped at a predetermined flow and back pressure into in-flow pipe 26, as shown by the arrows on the right hand side in FIG. 1. The liquid then passes at a speed of between 5 m/s to 30 m/s into the tubes 18 of the aeration cartridge 10. The internal diameter of tubes 18 is sufficiently large to allow misplaced particles to pass through the tubes 18 without causing a blockage. A high-pressure gas to be aerated into the liquid is pumped through inlet 34, as shown by the central arrow in FIG. 1, to fill outer vessel 32. The pressure of the gas in outer vessel 32, P1, is greater than the pressure of the liquid in the tubes 18, P2. As a result of the pressure differential between P1 and P2, the gas is forced through the slots 24 of the tubes 18. The flow of the liquid in tubes 18 shears the gas bubbles passing through slots 24, thus generating a large quantity of micro-bubbles in the liquid. The liquid in the tubes 18 then passes into out-flow pipe 28, as shown by the arrows on the left hand side of FIG. 1, and to a mixing section (not shown) to further disperse the micro-bubbles in the liquid.

The configuration and number of tubes 18 within aeration cartridge 10 will vary according to the type of liquid or suspension and the desired number of micro-bubbles to be dispersed throughout the liquid or suspension. Likewise the number and length of the cartridges within the device may also be varied.

Numerous variations and modifications may occur to, the reader without taking the resulting construction outside of the scope of the present invention. To give an example only, slots of varying size may be provided along the tube of the aeration cartridge to produce a bubble size distribution in the liquid.

Figure 2:
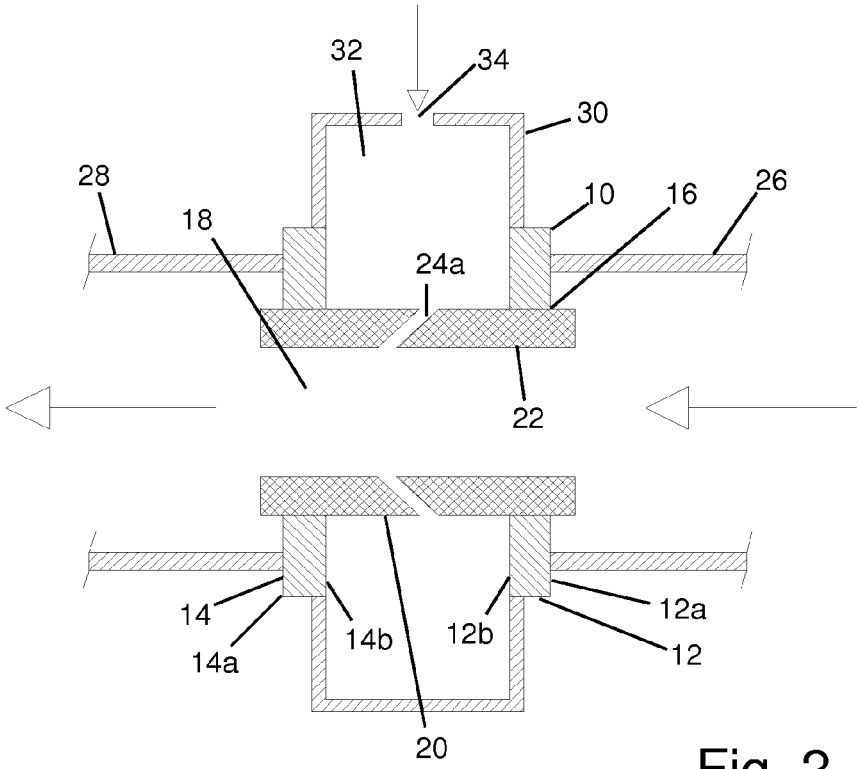
FIG. 2 shows a diagrammatic cross-section of an alternate embodiment of the device.

FIG. 2 shows an alternate embodiment of the device wherein the slots 24*a* are angled up to 60° to the perpendicular in either direction.

Figure 3:
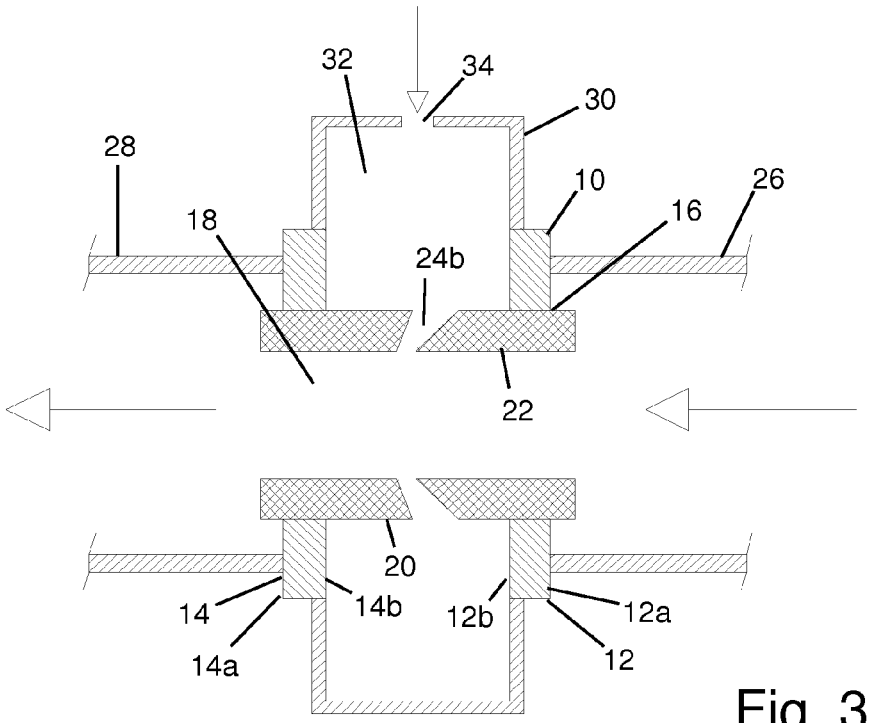
FIG. 3 shows a diagrammatic cross-section of a further alternate embodiment of the device.

FIG. 3 shows a further alternate embodiment of the device wherein the slots 24*b* are tapered in that they are wider on the outer surface of the tube 18 and narrowing on the inner surface of the tube 18.

The invention claimed is:

1. An aeration cartridge within an outer vessel, the aeration cartridge comprising a tube constructed from two or more longitudinally joined cylindrical sections, wherein respective ends of the cylindrical sections are shaped so that when they are joined together, at least one slot passing from an inner surface of the tube to an outer surface of the tube is created at the join, and wherein the outer vessel is capable of being connected to a high pressure gas supply, wherein at least part of the inner surface of the two or more cylindrical sections is superhydrophobic.

2. An aeration cartridge according to claim 1, wherein the at least one slot is perpendicular to the inner surface of the tube.

3. An aeration cartridge according to claim 1, wherein the at least one slot is angled up to 60° to the perpendicular to the inner surface of the tube in either direction.

4. An aeration cartridge according to claim 1 in which the at least one slot is tapered, being wider on the outer surface of the tube and narrowing on the inner surface of the tube.

5. An aeration cartridge according to claim 1, wherein the ends of the cylindrical sections are shaped by a Computer Numerical Control milling machine.

6. An aeration cartridge according to claim 1, wherein the cylindrical sections comprise ceramic material.

7. An aeration cartridge according to claim 6, wherein the ceramic material is SiC or $Al_2O_3$.

8. An aeration cartridge according. to claim 1, wherein the width of the at least one slot is between 0.01 mm and 0.5 mm.

9. An aeration cartridge according to claim 1, wherein the pressure of the high-pressure gas supply is 200 kilopascal (2 bar) to 1500 kilopascal (15 bar).

10. A method of dispersing a gas into a liquid using an aeration cartridge according to claim 1.

11. An aeration cartridge according to claim 2 in which the at least one slot is tapered, being wider on the outer surface of the tube and narrowing on the inner surface of the tube.

12. An aeration cartridge according to claim 3 in which the at least one slot is tapered, being wider on the outer surface of the tube and narrowing on the inner surface of the tube.

13. An aeration cartridge according to claim 2, wherein the ends of the cylindrical sections are shaped by a Computer Numerical Control milling machine.

14. An aeration cartridge according to claim 3, wherein the ends of the cylindrical sections are shaped by a Computer Numerical Control milling machine.

15. An aeration cartridge according to claim 4, wherein the ends of the cylindrical sections are shaped by a Computer Numerical Control milling machine.

16. An aeration cartridge according to claim 2, wherein the cylindrical sections comprise ceramic material.

17. An aeration cartridge according to claim 3, wherein the cylindrical sections comprise ceramic material.

18. An aeration cartridge according to claim 4 wherein the cylindrical sections comprise ceramic material.

19. An aeration cartridge according to claim 5, wherein the cylindrical sections comprise ceramic material.

20. An aeration cartridge according to claim 16, wherein the ceramic material is SiC or $Al_2O_3$.

21. An aeration cartridge according to claim 17, wherein the ceramic material is SiC or $Al_2O_3$.

22. An aeration cartridge according to claim 18, wherein the ceramic material is SiC or $Al_3$.

23. An aeration cartridge according to claim 19, wherein the ceramic material is SiC or $Al_2O_3$.

24. An aeration cartridge according to claim 2, wherein the width of the at least one slot is between 0.01 mm and 0.5 mm.

25. An aeration cartridge according to claim 3, wherein the width of the at least one slot is between 0.01 mm and 0.5 mm.

26. An aeration cartridge according to claim 4, wherein the width of the at least one slot is between 0.01 mm and 0.5 mm.

27. An aeration cartridge according to claim 5, wherein the width of the at least one slot is between 0.01 mm and 0.5 mm.

28. An aeration cartridge according to claim 6, wherein the width of the at least one slot is between 0.01 mm and 0.5 mm.

29. An aeration cartridge according to claim 7, wherein the width of the at least one slot is between 0.01 mm and 0.5 mm.

30. An aeration cartridge according to claim 2, wherein the pressure of the high-pressure gas supply is 200 kilopascal (2 bar) to 1500 kilopascal (15 bar).

31. An aeration cartridge according to claim 3, wherein the pressure of the high-pressure gas supply is 200 kilopascal (2 bar) to 1500 kilopascal (15 bar).

32. An aeration cartridge according to claim 4, wherein the pressure of the high-pressure gas supply is 200 kilopascal (2 bar) to 1500 kilopascal (15 bar).

33. An aeration cartridge according to claim 5, wherein the pressure of the high-pressure gas supply is 200 kilopascal (2 bar) to 1500 kilopascal (15 bar).

34. An aeration cartridge according to claim 6, wherein the pressure of the high-pressure gas supply is 200 kilopascal (2 bar) to 1500 kilopascal (15 bar).

35. An aeration cartridge according to claim 7, wherein the pressure of the high-pressure gas supply is 200 kilopascal (2 bar) to 1500 kilopascal (15 bar).

36. An aeration cartridge according to claim 8, wherein the pressure of the high-pressure gas supply is 200 kilopascal (2 bar) to 1500 kilopascal (15 bar).

* * * * *